US006974304B2

(12) United States Patent
Mantellassi et al.

(10) Patent No.: US 6,974,304 B2
(45) Date of Patent: Dec. 13, 2005

(54) CENTRIFUGAL COMPRESSOR FOR HIGH PRESSURE WITH IMPROVED EFFICIENCY

(75) Inventors: Stefano Mantellassi, Lamporecchio (IT); Stefano Franchi, Sesto Fiorentino (IT); Giovanni Mellone, Salerno (IT)

(73) Assignee: Nuovo Pignone Holding S.p.A., Florence (IT)

( * ) Notice: Subject to any disclaimer, the term of this patent is extended or adjusted under 35 U.S.C. 154(b) by 58 days.

(21) Appl. No.: 10/704,665

(22) Filed: Nov. 12, 2003

(65) Prior Publication Data

US 2004/0120812 A1 Jun. 24, 2004

(30) Foreign Application Priority Data

Dec. 23, 2002 (IT) ..... MI2002A2753

(51) Int. Cl.[7] ..... F01D 1/02

(52) U.S. Cl. ..... 415/199.2; 415/914

(58) Field of Search ..... 415/199.2, 224.5, 415/914

(56) References Cited

U.S. PATENT DOCUMENTS 3,976,395 A * 8/1976 Kalnin et al. ..... 415/199.2
2004/0006870 A1 * 1/2004 Sasu et al. ..... 29/889.2

* cited by examiner

*Primary Examiner*—Edward K. Look
*Assistant Examiner*—Richard A. Edgar
(74) *Attorney, Agent, or Firm*—Nixon & Vanderhye, P.C.

(57) ABSTRACT

A centrifugal compressor for high pressure (10) with improved efficiency, of the type comprising a rotor (12), an inner case (14), diffusers (16) and diaphragms (18), wherein the surfaces which are subjected to passage of the flow of gas have been subjected to burnishing working.

1 Claim, 1 Drawing Sheet

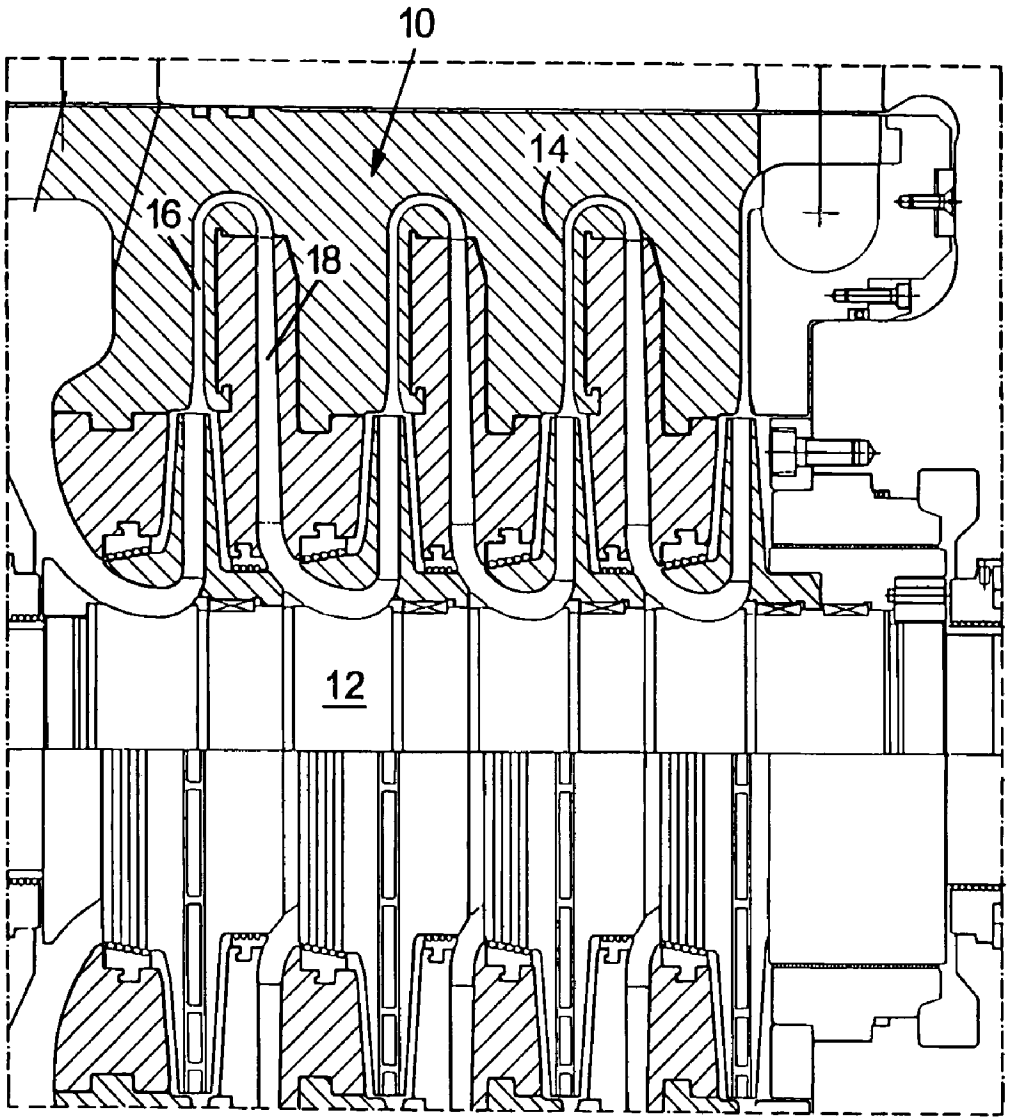
10
14
18
16
12

CENTRIFUGAL COMPRESSOR FOR HIGH PRESSURE WITH IMPROVED EFFICIENCY

The present invention relates to a centrifugal compressor for high pressure with improved efficiency. As is known, a centrifugal compressor is a machine which returns a compressible fluid at a pressure which is greater than that at which it received the fluid, by imparting to the fluid the energy necessary for the change of pressure, by means of the use of one or a plurality of impellers.

The rotor consists of the impellers, which contain radial blades, and are disposed such as to form channels for passage of the gas.

In centrifugal compressors, the impellers rotate in stators which consist of an inner case, the diaphragms, and the diffusers.

Considerable effort has been made in the technical field of compressors, and in particular those for high pressure, in order to obtain increasingly better performance, so as to absorb less power.

The object of the present invention is thus to eliminate partially the friction inside the gas passages, such as to provide a centrifugal compressor for high pressure with improved efficiency, in a simple manner, with low costs and with reduced times, without affecting the reliability of the machine.

The further characteristics of this centrifugal compressor with improved efficiency are contained in the successive claims.

The characteristics and advantages of the compressor will become more apparent and evident from the following description, provided by way of non-limiting example, with reference to the attached schematic drawing.

The FIGURE is a cross-section of the centrifugal compressor in question, which is indicated by 10 as a whole.

It comprises the rotor 12, the inner case 14, the diffusers 16 and the diaphragms 18, in accordance with the known art.

In the present invention, the surfaces which are subjected to the passage of the gas are subjected to burnishing processing, in order to reduce the surface roughness, and thus the friction which this surface exerts on the gas.

In particular, these surfaces, which belong to the inner case 14, to the diffusers 16 and to the diaphragms 18, are subjected to burnishing.

Burnishing is a surface treatment which is described briefly hereinafter.

From the point of view of roughness, a worked metal surface has an appearance formed by more or less accentuated peaks and depressions, which depend on the quality of the working carried out.

Burnishing consists of compressing this surface in cold conditions, under the pressure of treated rollers (burnishing tools). The tools rotate the part to be burnished.

This working has the following advantages:

- improvement of the surface condition of the worked part;
- it is an economical operation, since it is carried out on parts which have not been worked, and therefore makes it possible to avoid a more onerous operation such as grinding;
- extreme accuracy;
- increase in the resistance to fatigue of the parts which are subjected to high stress levels, and in particular to reciprocal stresses; and
- improvement in every case of the condition of the surface. It is possible to obtain a better level of finishing (without modifying the form) by means of tools with a smooth bright surface.

In the field of compressors, the burnishing operation is also used for the shafts, in particular on the surfaces which are read by the vibration sensors.

By means of the burnishing working according to the present invention, on the said parts of the centrifugal compressor 10, good reduction of roughness is obtained on the surfaces which are exposed to the flow of gas.

This reduction of roughness gives rise to an increase in the overall efficiency of the centrifugal compressor 10.

The description provided makes apparent the characteristics and the advantages which are obtained by means of the present invention.

In particular, the object is to show that by means of burnishing working which is particularly simple and economical, distinct improvements are obtained in the efficiency of the centrifugal compressor 10.

Finally, it is apparent that modifications and variations, all of which come within the scope of the invention, can be made to the centrifugal compressor for high pressure with improved efficiency, thus designed.

All the details can be replaced by technically equivalent elements.

In practice, any type of materials, forms and dimensions can be used, such as to comply with the technical requirements.

The scope of the invention is thus delimited by the attached claims.

What is claimed is:

1. A centrifugal compressor for high pressure comprising; a rotor, an inner case, diffusers and diaphragms each having surfaces subjected to passage of the flow of gas, said surfaces having been subjected to burnishing working.

* * * * *